US010105742B2

(12) United States Patent
O'Connor et al.

(10) Patent No.: US 10,105,742 B2
(45) Date of Patent: Oct. 23, 2018

(54) DRAW PRESS DIE ASSEMBLY AND METHOD OF USING THE SAME

(71) Applicant: Honda Motor Co., Ltd., Tokyo (JP)

(72) Inventors: Dennis O'Connor, Plain City, OH (US); Julio Malpica, Dublin, OH (US); Hideo Yazaki, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/564,134

(22) Filed: Dec. 9, 2014

(65) Prior Publication Data

US 2016/0158823 A1 Jun. 9, 2016

(51) Int. Cl.
*B21D 24/12* (2006.01)

(52) U.S. Cl.
CPC ..... *B21D 24/12* (2013.01)

(58) Field of Classification Search
CPC ..... B21D 22/20–22/30; B21D 24/04–24/08; B21D 37/10; B21D 24/12; B21D 24/10; B30B 1/18; B30B 1/28
See application file for complete search history.

(56) References Cited

U.S. PATENT DOCUMENTS

| | | | | |
|---|---|---|---|---|
| 3,201,967 | A | 8/1965 | Balamuth et al. | |
| 3,643,483 | A | 2/1972 | Minchenko | |
| 3,794,458 | A | 2/1974 | Iwasaki | |
| 3,855,487 | A * | 12/1974 | Boisseau | G01M 5/0016 310/80 |
| 3,879,974 | A | 4/1975 | Biddell et al. | |
| 4,226,111 | A | 10/1980 | Wahli | |
| 4,339,975 | A | 7/1982 | Carrieri | |
| 4,378,717 | A | 4/1983 | Schneider et al. | |
| 5,138,857 | A | 8/1992 | Siegert | |
| 5,588,344 | A | 12/1996 | Chun | |
| 6,021,658 | A | 2/2000 | Liinamaa et al. | |
| 6,053,027 | A | 4/2000 | Yoshizawa | |
| 6,070,521 | A | 6/2000 | Otoshi | |
| 6,199,271 | B1 | 3/2001 | Hahn et al. | |
| 6,227,090 | B1 | 5/2001 | Genseberger | |
| 6,810,704 | B2 | 11/2004 | Futamura et al. | |
| 6,862,913 | B2 | 3/2005 | Lempenauer et al. | |
| 6,871,586 | B2 | 3/2005 | Teraoka | |
| 7,102,316 | B2 | 9/2006 | Beyer et al. | |
| 7,165,437 | B2 | 1/2007 | Shin et al. | |
| 7,293,500 | B2 | 11/2007 | Futamura et al. | |
| 7,326,008 | B2 | 2/2008 | Chun et al. | |
| 7,415,862 | B2 | 8/2008 | Futamura et al. | |
| 7,421,878 | B2 | 9/2008 | Iwashita et al. | |

(Continued)

FOREIGN PATENT DOCUMENTS

| | | |
|---|---|---|
| DE | 4125992 | 2/1993 |
| DE | 102008011375 | 9/2009 |

(Continued)

*Primary Examiner* — Edward Tolan
*Assistant Examiner* — Mohammad Yusuf
(74) *Attorney, Agent, or Firm* — Rankin, Hill & Clark LLP

(57) ABSTRACT

A draw press die assembly includes an upper die, a lower die positioned beneath the upper die, a blankholder for supporting an associated workpiece, and a blankholder drive mechanism connected with at least one of the upper die and the blankholder. The blankholder drive mechanism is configured to provide a pulsating movement of the blankholder with respect to the upper die.

15 Claims, 5 Drawing Sheets

(56) References Cited

U.S. PATENT DOCUMENTS

| | | | | |
|---|---|---|---|---|
| 7,698,797 | B2 | 4/2010 | Hetrick et al. | |
| 7,765,848 | B2 | 8/2010 | Nagai et al. | |
| 7,958,765 | B2 | 6/2011 | Baba et al. | |
| 7,963,141 | B2 | 6/2011 | Nagai et al. | |
| 8,049,457 | B2 | 11/2011 | Okita et al. | |
| 8,443,643 | B2 | 5/2013 | Endo | |
| 8,468,866 | B2 | 6/2013 | Miyasaka et al. | |
| 2004/0031648 | A1 | 2/2004 | Rasmussen | |
| 2010/0095724 | A1 | 4/2010 | Kotagiri et al. | |
| 2011/0036140 | A1 | 2/2011 | Miyasaka et al. | |
| 2011/0132209 | A1 | 6/2011 | Senda et al. | |
| 2011/0185785 | A1 | 8/2011 | Goverdhana et al. | |
| 2011/0290125 | A1 | 12/2011 | Ito et al. | |
| 2011/0308294 | A1 | 12/2011 | Erlenmaier | |
| 2013/0151002 | A1 | 6/2013 | Spiesshofer et al. | |
| 2013/0180301 | A1 | 7/2013 | Schoellhammer et al. | |
| 2013/0180309 | A1 | 7/2013 | Polewski et al. | |
| 2014/0137755 | A1* | 5/2014 | Spiesshofer ..... | B21D 24/12 100/35 |
| 2014/0326116 | A1* | 11/2014 | Coleman ..... | B21D 28/14 83/14 |

FOREIGN PATENT DOCUMENTS

| | | |
|---|---|---|
| WO | 2012020569 | 2/2012 |
| WO | 2012123583 | 9/2012 |
| WO | 2012139566 | 10/2012 |

* cited by examiner

DRAW PRESS DIE ASSEMBLY AND METHOD OF USING THE SAME

BACKGROUND

Some metals, such as aluminum or high strength steel, are less formable in a conventional forming press as compared to mild steel. Deep drawing of such metals to form deep drawn parts, such as vehicle door inner panels and body side panels, presents many challenges. Some vehicle manufacturers have more than four press stages in manufacturing lines, some including two draw stages, which improves the ability to form deep drawn parts when compared to a single draw stage. Increasing the press stages, however, results in additional capital costs and more time and energy required to manufacture these deep drawn parts.

SUMMARY

In view of the foregoing, a new draw press die assembly is provided. Such a draw press die assembly includes an upper die, a lower die positioned beneath the upper die, a blankholder for supporting an associated workpiece, and a blankholder drive mechanism connected with at least one of the upper die and the blankholder. The blankholder drive mechanism is configured to provide a pulsating movement of the blankholder relative to the upper die.

A method for drawing a metal part includes moving an upper die in a downward direction toward a workpiece positioned on a blankholder. The method further includes controlling a blankholder drive mechanism positioned at least partially within at least one of the upper die and the blankholder to provide a pulsating movement of the blankholder relative to the upper die.

An example of a blankholder includes a main blankholder, a sub blankholder that is moveable relative to the main blankholder, and a blankholder drive mechanism mounted to the main blankholder. The blankholder drive mechanism oscillates the sub blankholder.

DETAILED DESCRIPTION

Figure 1:
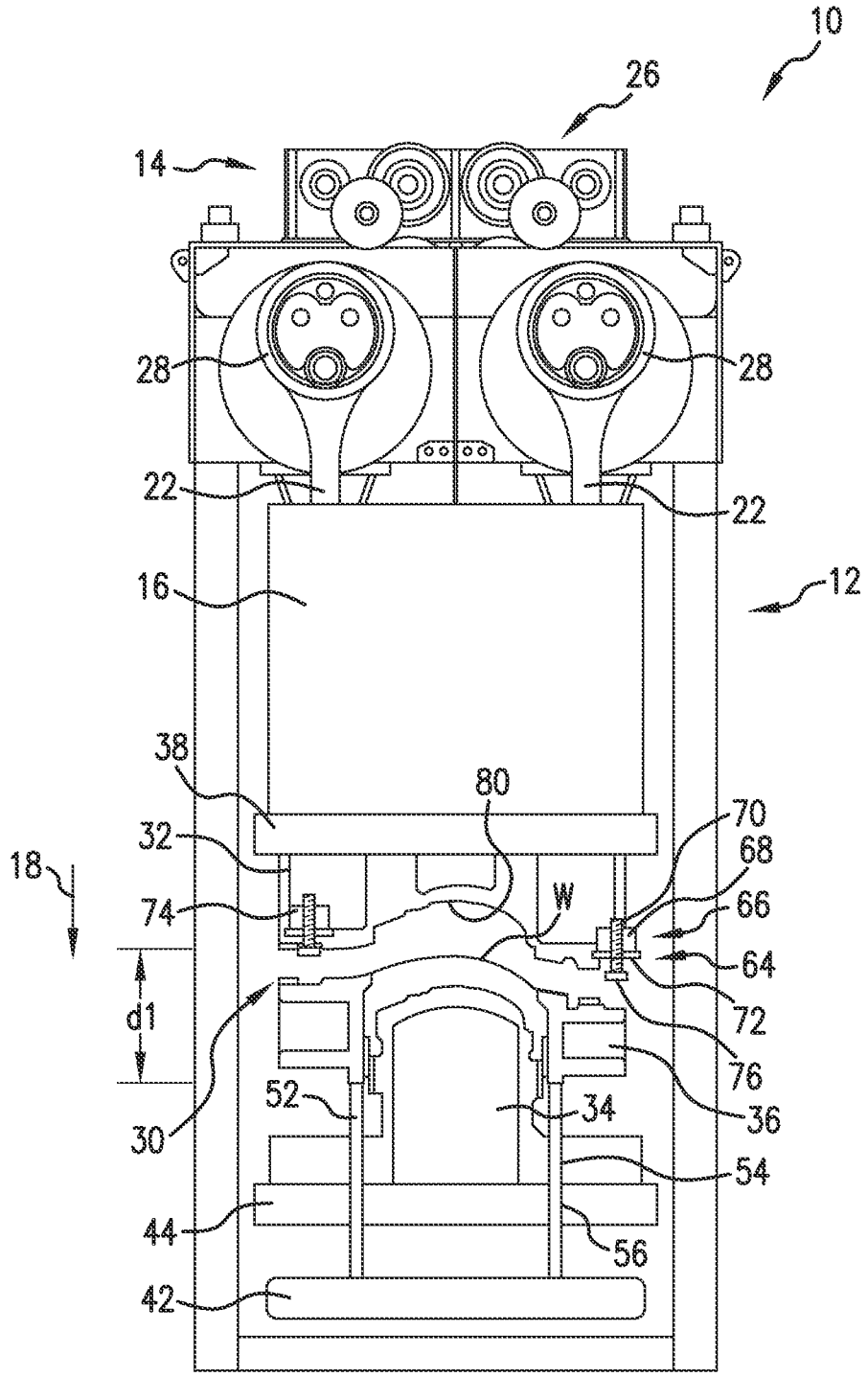
FIG. 1 is a schematic depiction of an exemplary draw press prior to an upper die and a lower die engaging a workpiece.

With reference to FIG. 1, a draw press 10 is shown that can be used to form a deep drawn part from a metal or metal alloy sheet, hereinafter referred to as workpiece W. The draw press 10 includes a frame 12 that can be similar to frames found in conventional draw presses. The draw press 10 also includes a first drive mechanism 14 connected to the frame 12. A slide 16 is movably connected with the frame 12 and is operably connected with the first drive mechanism, which can also be referred to as an upper die drive mechanism 14. The slide 16 is driven by the first drive mechanism 14 so as to be movable with respect to the frame 12 a distance dl in a first (downward in FIG. 1) direction (arrow 18 in FIG. 1). The first drive mechanism 14 in the illustrated embodiment is an eccentric drive mechanism. The first distance dl is the distance that the slide 16 is movable with respect to the frame 12, which is a function of the eccentricity of first drive mechanism 14. The first drive mechanism 14 is shown as an eccentric drive mechanism; however, the first drive mechanism may be any mechanism capable of moving the slide 16 in the desired manner and is not limited to eccentric drive mechanisms. The first drive mechanism 14 includes a plurality of servo motors (not shown) operably connected with connecting rods 22 through a gear train 26 and eccentric rings 28. The first drive mechanism 14 can be similar to conventional eccentric drive mechanisms found in conventional draw presses.

In the embodiment illustrated in FIG. 1, the draw press 10 includes a first die assembly 30. The first die assembly 30 includes an upper die 32, a lower die 34, and a blankholder 36. The upper die 32 is secured to the slide 16 and moves with the slide 16. In the illustrated embodiment, an upper die mounting plate 38 is positioned between the upper die 32 and the slide 16. In the illustrated embodiment, the upper die 32 mounts to the upper die mounting plate 38, which mounts to and moves with the slide 16.

In the embodiment illustrated in FIG. 1, the draw press 10 also includes a cushion plate 42 and a press bolster 44. Pins 52 connect the blankholder 36 to the cushion plate 42. In the illustrated embodiment, the lower die 34 includes openings 54 through which the pins 52 extend to connect the blankholder 36 with the cushion plate 42. A pin plate (not shown) can be disposed on the top of the cushion plate 42. The pins 52 can connect with and extend from the pin plate and move with the cushion plate 42. The bolster 44, which includes openings 56 through which the pins 52 extend, limits upward travel of the cushion plate 42. The cushion plate 42 can move with respect to the frame 12 and can be supported by a cushion slide (not shown) in a conventional manner.

Figure 2:
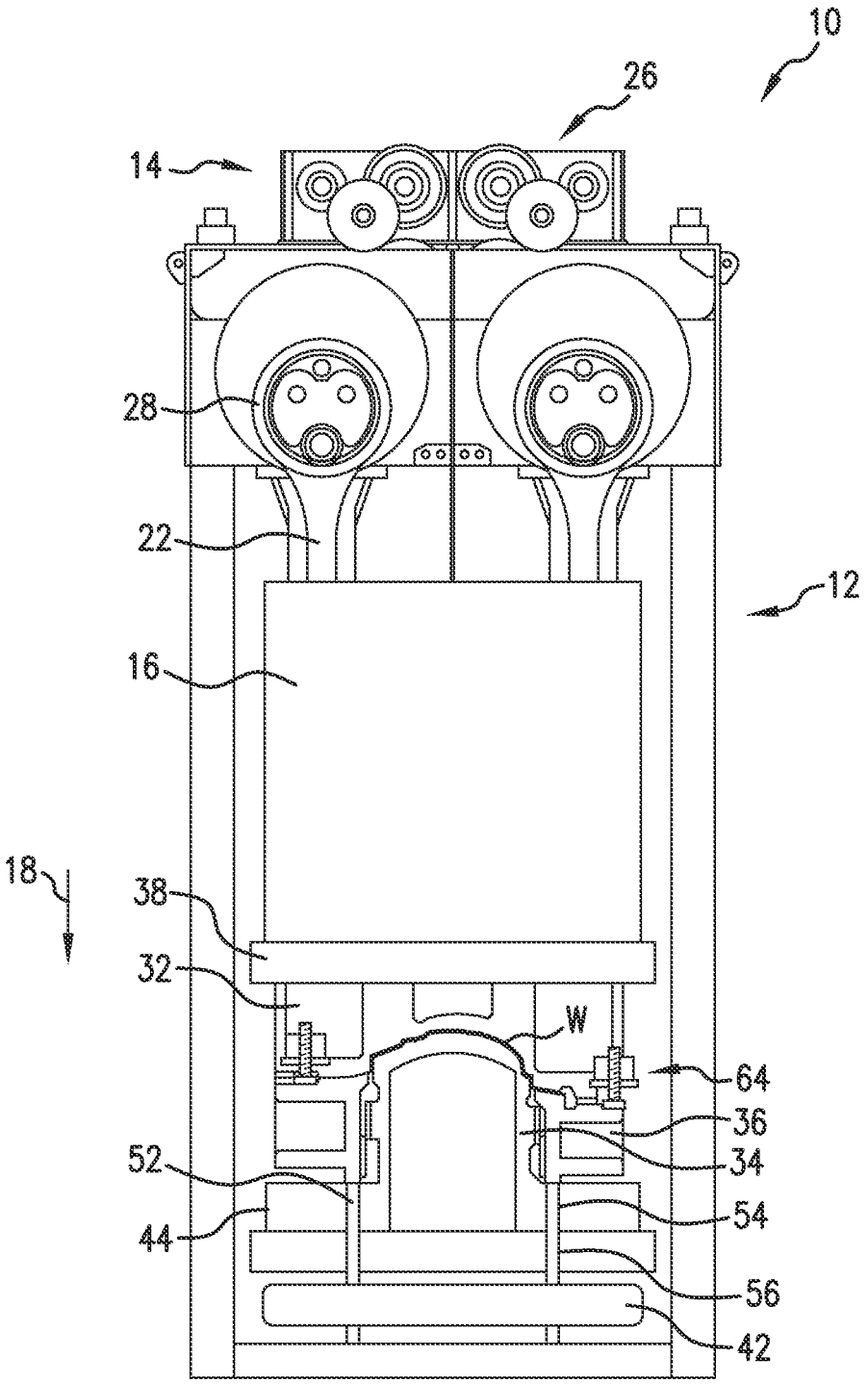
FIG. 2 is a schematic depiction of the draw press of FIG. 1 with the upper die and the blankholder engaging the workpiece.
Figure 3:
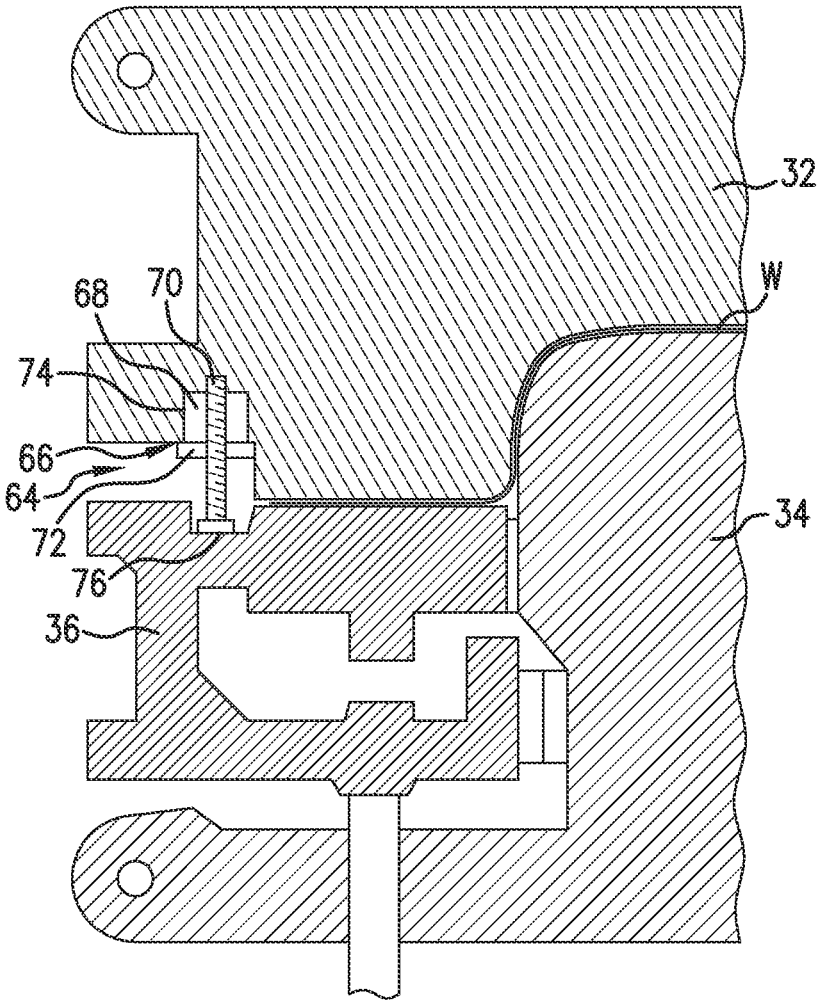
FIG. 3 is a cross-sectional view of a portion of the die assembly shown in FIG. 1. with the upper die and the lower die engaging the workpiece and a blankholder drive mechanism mounted to the upper die.

In the embodiment depicted in FIG. 1, the die assembly 30 also includes a blankholder drive mechanism 64 connected with, and/or at least partially included within, the upper die 32 for movement with the upper die (see FIG. 3). The blankholder drive mechanism 64 is configured to oscillate the blankholder 36. In the illustrated embodiment, the blankholder drive mechanism 64 includes a plurality of servo spindles 66 (two are depicted in FIG. 1) each connected with the upper die 32 for movement therewith. Although illustrated as including two servo spindles 66, the blankholder drive mechanism 64 may include any number of servo spindles 66 that allows the die assembly 30 to function as described herein. The blankholder drive mechanism 64 depicted in FIG. 1 is fixed to the upper die 32 such that when the upper die 32 moves, the blankholder drive mechanism 64 also moves. Each servo spindle 66 includes a servo motor 68 connected with a spindle 70, which cooperates with a spindle nut 72. The upper die 32 can include a cavity 74 that receives a respective servo spindle 66. Servo spindles 66 (such as the one on the right in FIG. 1) can also be mounted outside or on an external surface of the upper die 32. The upper die 32 includes a workpiece contact area 80 that contacts the workpiece W during a press operation as shown in FIG. 2. The blankholder drive mechanism 64 mounts to the upper die 32 at a section of the upper die that is exterior of the workpiece contact area 80.

As will be described in more detail below, the blankholder drive mechanism 64 is configured to pulsate or oscillate the blankholder 36 during a press operation. The oscillation motion is synchronized to release the workpiece W by making the upper die 32 and the blankholder 36 release for a fraction of the time. This reduces stress and/or strain in the workpiece W to reduce and/or avoid material fracturing. By better controlling material flow, deeper drawing may be achieved. This pulsating or oscillating movement can occur at a frequency greater than about 15 Hz. In one embodiment, the blankholder 36 is pulsated or oscillated at about 50 Hz. The spindle 70 includes a distal end 76 configured to engage the blankholder 36. The blankholder drive mechanism 64 moves the blankholder 36 in a direction parallel to a direction in which the upper die 32 moves. The blankholder drive mechanism 64 moves the blankholder 36 downward in the direction of arrow 18. An upward force applied to the blankholder 36 by the pins 52 moves the blankholder 36 upward in the direction opposite the arrow 18 when the downward force is not being applied by the blankholder drive mechanism 64. This allows for the oscillating (up and down) movement.

Operation of the draw press 10 will now be described in accordance with an embodiment of the present disclosure. More specifically, a method for drawing a metal part will be described. Even though the method will be described with reference to the draw press 10 described above, the method described below and also referred to in the claims could be used with other draw presses. The method for drawing a metal part, such as the workpiece W, includes moving the upper die 32 in a downward direction (arrow 18 in FIG. 1) toward the workpiece W positioned on the lower die 34 and the blankholder 36. The method also includes oscillating the blankholder 36 while the upper die 32 is in contact with the workpiece W. Oscillating the blankholder 36 can include moving the blankholder 36 in a direction parallel to the downward direction, shown as arrow 18 in FIG. 1. In other words, the blankholder 36 can be oscillated by the blankholder drive mechanism 64 and the upward force of the pins 52 in an up and down manner parallel to arrow 18. The blankholder 36 is oscillated using the blankholder drive mechanism 64 mounted to the upper die 32 in the embodiment depicted in FIG. 1. As such, the blankholder 36 is oscillated using the spindle servo motor 68 mounted to the upper die 32.

Figure 4:
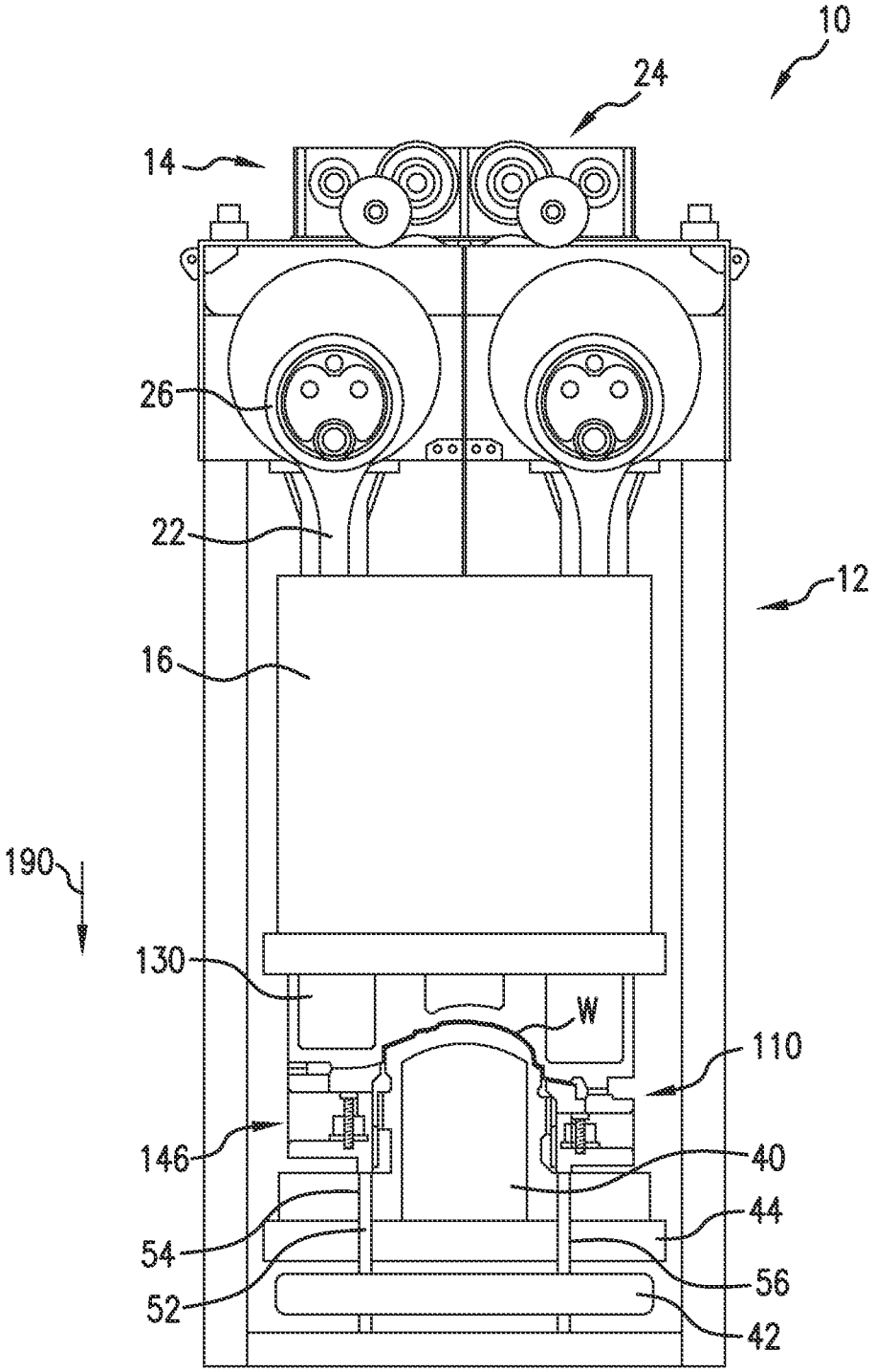
FIG. 4 is a schematic depiction of an alternative embodiment of the draw press shown in FIG. 1.

FIG. 4 is a schematic diagram of an alternative embodiment 110 of the die assembly 30 (shown in FIG. 1). In the embodiment illustrated in FIG. 4, the draw press 10 includes the die assembly 110. The die assembly 110 differs from the die assembly 30 depicted in FIGS. 1 and 2 by including a blankholder 146 that is coupled to, and/or at least partially contains, a blankholder drive mechanism 164. Furthermore, the die assembly 110 includes an upper die 130 that is similar to the upper die 32 (shown in FIG. 1), with the exception that no blankholder drive mechanisms are mounted to or within the upper die 130. As such, the upper die 130 can be similar to conventional upper dies used with conventional draw presses.

Figure 5:
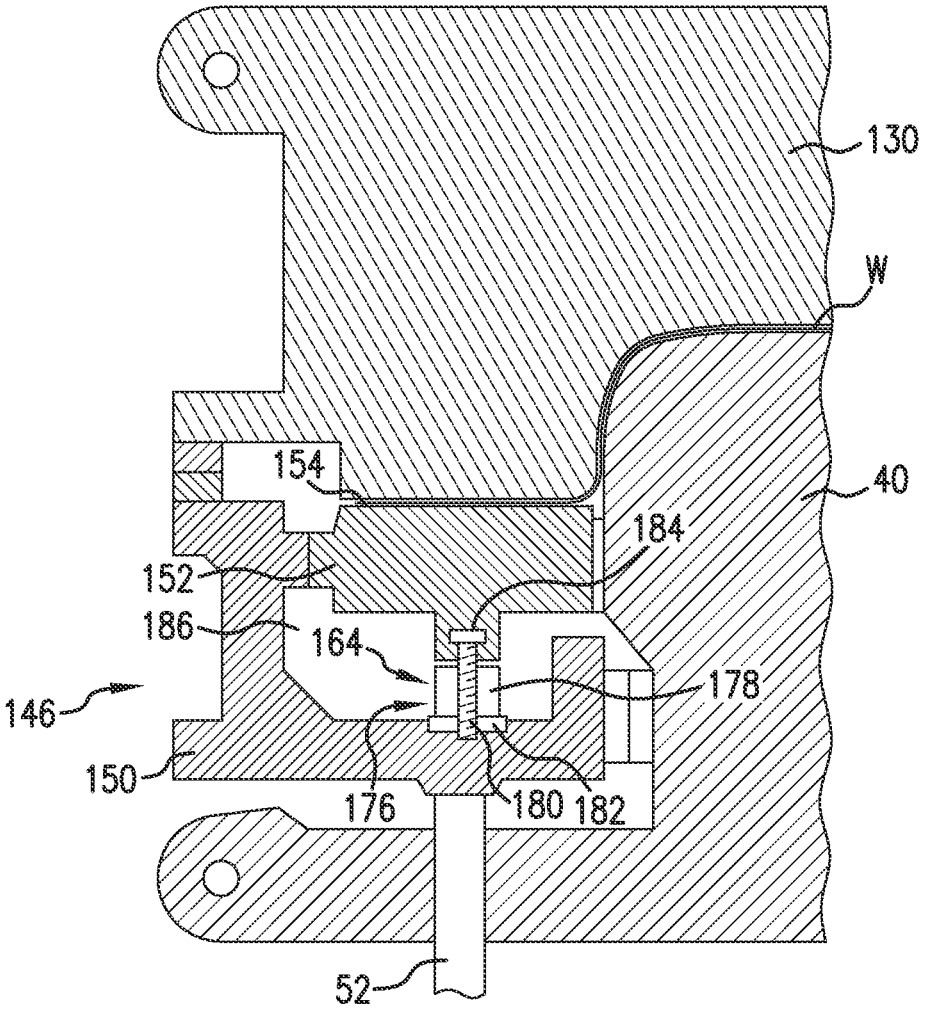
FIG. 5 is a schematic cross-sectional view of an exemplary die assembly included in the draw press depicted in FIG. 4.

FIG. 5 is a schematic diagram of the die assembly 110 shown in FIG. 4. In the embodiment illustrated in FIG. 5, the blankholder 146 includes a main blankholder 150 and a sub blankholder 152 that is movable relative to the main blankholder 150. The sub blankholder 152 includes a support surface 154 that is in contact with the workpiece W during the press operation. The blankholder drive mechanism 164, which is similar to the blankholder drive mechanism 64 depicted in FIGS. 1 and 2, mounts to the main blankholder 150 for oscillating the sub blankholder 152. The blankholder drive mechanism 164 is secured to the main blankholder 150 for movement therewith such that when the main blankholder 150 moves, the blankholder drive mechanism 164 also moves. The blankholder drive mechanism 164 includes a plurality of servo spindles 176 each connected with the main blankholder 150 for movement therewith. Each servo spindle 176 includes a servo motor 178 connected with a spindle 180, which cooperates with a spindle nut 182. The spindle includes a distal end 184 for engaging the sub blankholder 152. As illustrated, the main blankholder 150 includes a cavity 186 that can receive the blankholder drive mechanism 164.

Operation of the die assembly 110 will now be described in accordance with an embodiment of the present disclosure. More specifically, a method for drawing a metal part will be described. Even though the method will be described with reference to the draw press 10 and die assembly 110 described above, the method described below and also referred to in the claims could be used with other draw presses and die assemblies.

With reference to FIGS. 4 and 5, the method for drawing a metal part includes moving the upper die 130 in a downward direction (see arrow 190 in FIG. 4) toward the workpiece W positioned on the lower die 34 and the blankholder 146. The method further includes oscillating and/or pulsing the blankholder 146, and more specifically, the sub blankholder 152, while the upper die 130 is in contact with the workpiece W. Oscillating the blankholder 146 can include moving the sub blankholder 152 up and down with respect to the main blankholder 150 in the direction parallel to the downward direction, i.e., in the direction parallel with arrow 190. The sub blankholder 152 can be oscillated using the spindle servo motor 176 mounted to the main blankholder 150. Similar to the embodiment described above, the oscillating/pulsating movement can occur at a frequency greater than about 15 Hz, and in some embodiments can occur at about 50 Hz or greater.

A draw press 10 has been described above that includes either die assembly 30 (shown in FIGS. 1-3) or die assembly 110 (shown in FIGS. 4-5). As described above, blankholder drive mechanism 64, 164 is connected with at least one of the upper die 32, 130 and the blankholder 36, 146. The blankholder drive mechanism 64, 164 is configured to oscillate the blankholder 36, 146. The die assemblies 30, 110 described above can upgrade the capabilities of currently used draw presses without modifying the draw press itself, but instead by replacing a currently used die assembly with the die assemblies discussed herein. The die assemblies described herein represent an economical way to upgrade the capabilities of current draw presses as the die assembly of a current draw press is changed, for example, when a new part is to be formed by the press. Modifications and alterations will occur to those upon reading and understanding the preceding detailed description. The invention is not limited to only the embodiments described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A draw press die assembly comprising:

an upper die secured to a slide connected with at least one connection rod that is operably connected to an upper die drive mechanism to move the upper die;

a lower die positioned beneath the upper die;

a blankholder for supporting an associated workpiece, said blankholder connected to a cushion plate via pins; and a blankholder drive mechanism mounted in the upper die for movement therewith, the blankholder drive mechanism configured to oscillate the blankholder at a frequency greater than 15 Hz relative to the upper die, and such oscillation includes movement of the blankholder in a direction parallel to a direction in which the upper die is moved by the upper die drive mechanism during a press operation, wherein movement of the blankholder away from the upper die during oscillation is effected by the blankholder drive mechanism and movement of the blankholder back toward the upper die during oscillation is effected by the cushion plate via the pins;

wherein the upper die and the blankholder release the workpiece during each movement of the blankholder away from the upper die during oscillation.

2. The die assembly of claim 1, wherein the blankholder drive mechanism is a spindle servo motor.

3. The die assembly of claim 1, wherein the blankholder drive mechanism is separable from the blankholder when the upper die is moved apart from the lower die.

4. The die assembly of claim 3, wherein the blankholder drive mechanism is a spindle servo motor including a spindle having a distal end configured to engage the blankholder, said distal end extending from the upper die and retracting toward the upper die during said oscillation of the blankholder.

5. The die assembly of claim 4, wherein the upper die includes a workpiece contact area that contacts the associated workpiece during the press operation, and the blankholder drive mechanism is mounted in the upper die at a section of the upper die exterior of the workpiece contact area, wherein the workpiece contact area is disposed away from the distal end of the spindle of the blankholder drive mechanism.

6. The die assembly of claim 1, wherein upper die drive mechanism includes a plurality of servo motors operably connected with the at least one connection rod through a gear train and at least one eccentric ring.

7. The die assembly of claim 1, wherein the blankholder includes a main blankholder and a sub blankholder.

8. The die assembly of claim 7, wherein the blankholder drive mechanism moves the sub blankholder with respect to the main blankholder.

9. The die assembly of claim 8, wherein the blankholder drive mechanism mounts to the main blankholder.

10. The die assembly of claim 8, wherein the blankholder drive mechanism is a spindle servo motor including a spindle having a distal end configured to engage the sub blankholder.

11. A method for drawing a metal part comprising:

moving an upper die in a downward direction toward a workpiece positioned on a blankholder, wherein the upper die is secured to a slide connected with at least one connection rod that is operably connected to an upper die drive mechanism to move the upper die; and controlling a blankholder drive mechanism positioned at least partially within the upper die to oscillate the blankholder at a frequency greater than 15 Hz relative to the upper die and thereby move the blankholder in a direction parallel to a direction in which the upper die is moved by the upper die drive mechanism during a press operation, wherein movement of the blankholder away from the upper die during oscillation is effected by the blankholder drive mechanism and movement of the blankholder back toward the upper die during oscillation is effected by a cushion plate;

wherein the upper die and the blankholder release the workpiece during each movement of the blankholder away from the upper die during oscillation.

12. The method of claim 11, wherein the upper die drive mechanism includes a plurality of servo motors operably connected with the at least one connection rod through a gear train and at least one eccentric ring.

13. The method of claim 11, wherein controlling the blankholder drive mechanism comprises controlling a spindle servo motor mounted in the upper die.

14. The method of claim 11, wherein the blankholder includes a main blankholder and a sub blankholder, and wherein controlling the blankholder drive mechanism comprises controlling a spindle servo motor mounted to the main blankholder and configured to provide a pulsating movement of the sub blankholder with respect to the main blankholder.

15. A draw press die assembly comprising:

an upper die secured to a slide connected with at least one connection rod that is operably connected to an upper die drive mechanism to move the upper die;

a lower die positioned beneath the upper die;

a blankholder for supporting an associated workpiece;

a blankholder drive mechanism mounted in the upper die, the blankholder drive mechanism moving the associated workpiece away from the upper die when actuated; and pins that extend through openings in the lower die to connect the blankholder to a cushion plate, wherein the cushion plate and the pins move the associated workpiece back toward the upper die only when the black holder drive mechanism is not actuated;

wherein movement of the associated workpiece away from and back toward the upper die occurs at a frequency greater than 15 Hz;

wherein the upper die and the blankholder release the workpiece during each movement of the associated workpiece away from the upper die.

* * * * *